US010992033B1

(12) United States Patent
Lee et al.

(10) Patent No.: US 10,992,033 B1
(45) Date of Patent: Apr. 27, 2021

(54) ANTENNA APPARATUS

(71) Applicant: Samsung Electro-Mechanics Co., Ltd., Suwon-si (KR)

(72) Inventors: Hong Seok Lee, Suwon-si (KR); Bo Hyun Seo, Suwon-si (KR); Sung Youl Choi, Suwon-si (KR); Young Ki Lee, Suwon-si (KR); Tae Gyu Ryu, Suwon-si (KR); Seog Moon Choi, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 16/789,968

(22) Filed: Feb. 13, 2020

(30) Foreign Application Priority Data

Oct. 23, 2019 (KR) ..... 10-2019-0132340

(51) Int. Cl.
*H01Q 1/32* (2006.01)
*H01Q 13/02* (2006.01)

(52) U.S. Cl.
CPC ..... *H01Q 1/3233* (2013.01); *H01Q 13/02* (2013.01)

(58) Field of Classification Search
CPC ..... H01Q 1/3233; H01Q 1/48; H01Q 1/243; H01Q 1/521; H01Q 13/02; H01Q 21/065; H01Q 21/28
USPC ..... 343/848, 846, 700 MS
See application file for complete search history.

(56) References Cited

U.S. PATENT DOCUMENTS 6,052,098 A * 4/2000 Killen ..... H01Q 9/285 343/795
8,170,498 B2 * 5/2012 Rofougaran ..... H01Q 1/2283 455/73
8,947,180 B2 * 2/2015 Kawamura ..... H01Q 1/24 333/239
9,287,903 B2 * 3/2016 Takeda ..... H01P 1/06
2001/0050654 A1 * 12/2001 Killen ..... H01Q 5/49 343/817
2005/0264450 A1 * 12/2005 Nishiyama ..... H01Q 21/065 343/700 MS
2009/0015353 A1 * 1/2009 Rofougaran ..... H01L 24/06 333/24 C
2011/0043430 A1 * 2/2011 Bashan ..... G06K 19/07779 343/866
2011/0267254 A1 * 11/2011 Semar ..... G06K 19/07749 343/870
2014/0347242 A1 * 11/2014 Seo ..... H01Q 1/243 343/848
2015/0107092 A1 * 4/2015 Bashan ..... G06K 19/0775 29/601
2020/0388910 A1 * 12/2020 Chitaka ..... H01Q 1/3275

FOREIGN PATENT DOCUMENTS

JP 3882373 B2 2/2007
KR 10-2018-0075043 A 7/2018
KR 10-1987393 B1 6/2019

* cited by examiner

*Primary Examiner* — Lam T Mai
(74) *Attorney, Agent, or Firm* — NSIP Law

(57) ABSTRACT

An antenna apparatus includes a substrate, a transmission antenna disposed on the substrate, and an auxiliary substrate disposed in an upper portion of the transmission antenna and having a radio wave guide unit having a horn shape. The auxiliary substrate further includes an insulator and a second metal pattern disposed in the radio wave guide unit on the insulator.

16 Claims, 3 Drawing Sheets

320

420

520

ANTENNA APPARATUS

CROSS-REFERENCE TO RELATED APPLICATIONS

This application claims the benefit under 35 U.S.C. 119(a) of Korean Patent Application No. 10-2019-0132340 filed on Oct. 23, 2019, in the Korean Intellectual Property Office, the entire disclosure of which is incorporated herein by reference for all purposes.

BACKGROUND

1. Field

The present disclosure relates to an antenna apparatus.

2. Description of the Background

As autonomous vehicle technology develops, the importance of radar, together with light detection and ranging (LiDAR) and cameras, is increasing. A radar apparatus may be mounted on a vehicle because radar can sense an object with less reliance on visibility compared to LiDAR and cameras, considering various weather and other poor visibility conditions of actual driving environments.

Currently, commercially available electric radars mainly include a front long-range radar (LRR) using a 77 GHz band, a mid-range radar (MRR)/a short-range radar (SRR) for a blind spot detection (BSD) using a 24 GHz band and a parking assistant system (PAS) application also using a 24 GHz band.

However, as a use frequency of electric radars is recently limited to the 79 GHz band, it is expected to expand a product and a market scale of the electric radar for the 79 GHz band. Therefore, there is a need for development of an antenna apparatus capable of securing radio wave acquisition characteristics while designing a wide field of view (FOV).

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna apparatus includes a substrate, a transmission antenna disposed on the substrate, and an auxiliary substrate disposed in an upper portion of the transmission antenna and including a radio wave guide unit having a horn shape. The auxiliary substrate further includes an insulator and a second metal pattern disposed in the radio wave guide unit on the insulator.

The substrate may include a plurality of vias disposed to surround the transmission antenna.

An interval between the vias may be 380 μm or less.

The antenna apparatus may further include a reception antenna disposed on the substrate adjacent to the transmission antenna.

The transmission antenna may include a plurality of layers.

The transmission antenna disposed in an upper portion of the transmission antenna forming the plurality of layers may be smaller than the transmission antenna disposed in a lower portion thereof.

The second metal pattern may be disposed on top and bottom surfaces of the insulator.

The substrate may include a first metal pattern corresponding to the shape of the auxiliary substrate and disposed on the upper surface of the substrate.

The substrate and the auxiliary substrate may be bonded to each other by solder.

The radio wave guide unit may include a first radio wave guide unit in which an inner surface of the insulator is disposed vertically, and a second radio wave guide unit in which an inner surface of the insulator is inclined to extend from the first radio wave guide unit.

The first radio wave guide unit may include a height of 0.1 mm to 0.8 mm.

The second radio wave guide unit may include a height of 0.4 mm to 1.6 mm.

An inner surface of the insulator forming the second radio wave guide unit may include an inclination angle of 25° to 75°.

In another general aspect, an antenna apparatus includes a substrate, a transmission antenna disposed on the substrate, and an auxiliary substrate comprising a radio wave guide unit disposed in an upper portion of the transmission antenna, wherein the transmission antenna includes a first transmission antenna disposed on an upper surface of the substrate and a second transmission antenna disposed in a lower portion than the first transmission antenna and having a larger size than the first transmission antenna.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
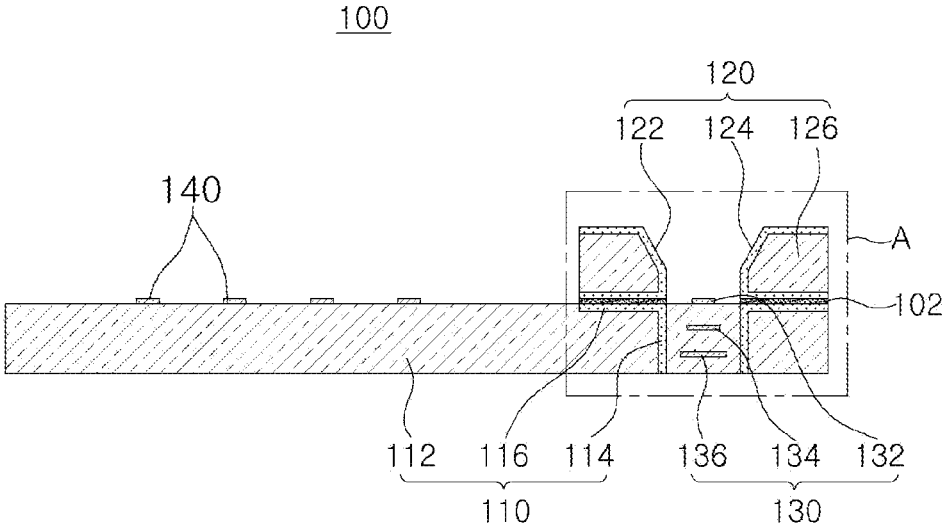
FIG. 1 is a schematic cross-sectional view illustrating one or more examples of an antenna apparatus according to an embodiment of the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of this disclosure. For example, the sequences of operations described herein are merely examples, and are not limited to those set forth herein, but may be changed as will be apparent after an understanding of this disclosure, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of this disclosure. Hereinafter, while embodiments of the present disclosure will be described in detail with reference to the accompanying drawings, it is noted that examples are not limited to the same.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween. As used herein "portion" of an element may include the whole element or less than the whole element.

As used herein, the term "and/or" includes any one and any combination of any two or more of the associated listed items; likewise, "at least one of" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms, such as "above," "upper," "below," "lower," and the like, may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above," or "upper" relative to another element would then be "below," or "lower" relative to the other element. Thus, the term "above" encompasses both the above and below orientations depending on the spatial orientation of the device. The device may be also be oriented in other ways (rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of this disclosure. Further, although the examples described herein have a variety of configurations, other configurations are possible as will be apparent after an understanding of this disclosure.

Herein, it is noted that use of the term "may" with respect to an example, for example, as to what an example may include or implement, means that at least one example exists in which such a feature is included or implemented while all examples are not limited thereto.

An aspect of the present disclosure is to provide an antenna apparatus capable of securing radio wave acquisition characteristics while widening a field of view (FOV).

Figure 2:
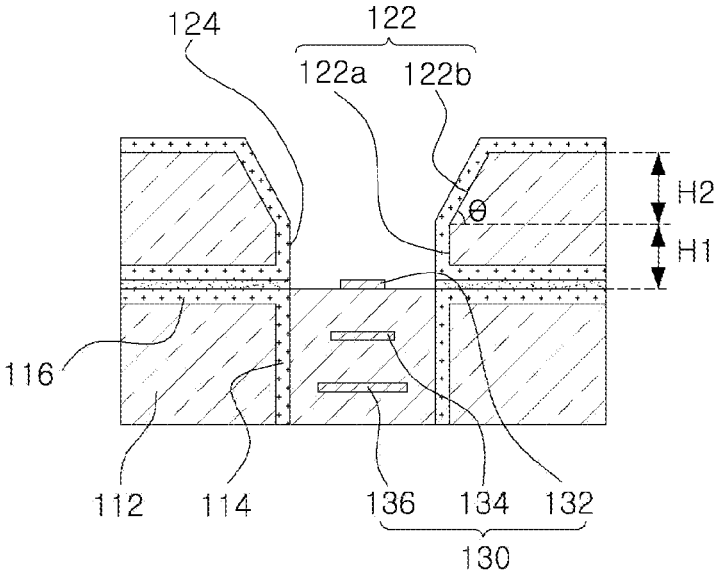
FIG. 2 is an enlarged view illustrating part A of FIG. 1.

FIG. 1 is a schematic cross-sectional view illustrating one or more examples of an antenna apparatus according to an embodiment of the present disclosure, and FIG. 2 is an enlarged view illustrating part A of FIG. 1.

Referring to FIGS. 1 and 2, an antenna apparatus 100 according to an embodiment of the present disclosure may include, for example, a substrate 110, an auxiliary substrate 120, a transmission antenna 130, and a reception antenna 140.

The substrate 110 may have a flat-plate shape, and may include an insulating layer 112 and a wiring layer (not shown). Meanwhile, a material of the insulating layer 112 may be a thermosetting resin such as an epoxy resin, a thermoplastic resin such as polyimide, or a resin in which these resins are impregnated with a core such as glass fiber, glass cloth, and glass fabric together with an inorganic filler. For example, an insulating material such as prepreg, Ajinomoto build-up film (ABF), FR-3, and bismaleimide triazine (BT) may be used. In addition, as a material of the wiring layer, a conductive material such as copper (Cu), aluminum (Al), silver (Ag), tin (Sn), gold (Au), nickel (Ni), lead (Pb), titanium (Ti), alloys thereof, or the like may be used.

As an example, the substrate 110 may be any one of a rigid printed circuit board, a flexible printed circuit board, or a rigid-flexible printed circuit board. In addition, the substrate 110, may be, for example, either a single layer printed circuit board or a multilayer printed circuit board.

The substrate 110 may be provided with a plurality of external terminals (not shown) connected to the wiring layer, and the external terminals may be formed of a solder ball, a conductive bump, a pin grid array, a lead grid array, a copper pillar, or a combination thereof.

Figure 3:
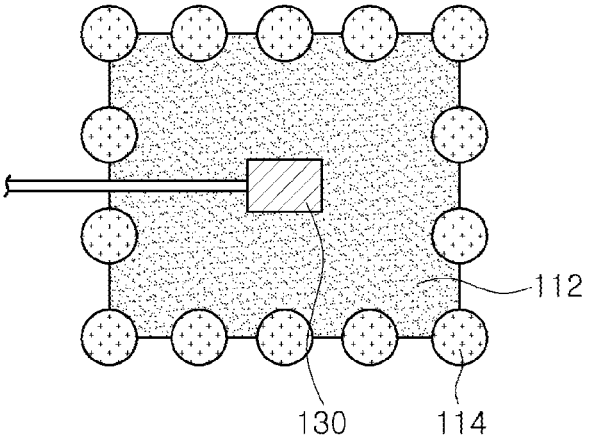
FIG. 3 is an explanatory view illustrating one or more examples of a via provided in a substrate of an antenna apparatus according to an embodiment of the present disclosure.

In addition, the substrate 110 may be provided with a plurality of vias 114 disposed to surround a periphery of the transmission antenna 130 as illustrated in FIG. 3. The vias 114 may serve to reduce leakage of radio waves transmitted from the transmission antenna 130. Therefore, an interval between the vias 114 may have a narrow interval to suppress the leakage of radio waves. As an example, considering that a wavelength in a 79 GHz band is 3.8 millimeters (mm), the interval between the vias 114 may be disposed at intervals of 380 microns (μm) or less, which is 1/10 of the wavelength, to prevent the leakage of radio waves.

In the present example embodiment, a case in which the via 114 has a cylindrical shape is described as an example, but is not limited thereto, the shape of the via 114 may be variously modified. As an example, the via 114 may be implemented in a cylindrical or rectangular shape according to a manufacturing method. The cylindrical shape may be manufactured using a drill, and the rectangular shape may be manufactured by forming a cavity using a punch and stacking layers of the substrate.

In addition, the substrate 110 may be provided with a first metal pattern 116 disposed in a lower portion of the auxiliary substrate 120. The first metal pattern 116 may have a shape corresponding to a shape of a lower surface of the auxiliary substrate 120. As an example, the first metal pattern 116 may have a hollow rectangular shape.

The auxiliary substrate 120 is bonded to an upper surface of the substrate 110. As an example, the auxiliary substrate 120 may be bonded and installed to the upper surface of the substrate 110 by soldering a solder 102. The auxiliary substrate 120 may be formed with a radio wave guide unit 122 disposed in an upper portion of the transmission antenna 130. The radio wave guide unit 122 may be formed of an opening having a funnel (horn) shape. In addition, the auxiliary substrate 120 may be provided with a second metal pattern 124 formed on at least an inner surface of the auxiliary substrate 120. As an example, the second metal pattern 124 of the auxiliary substrate 120 may be provided on an upper surface, an inner surface, and a lower surface of the auxiliary substrate 120. The second metal pattern 124 of the auxiliary substrate 120 may be formed on a surface of the insulator 126. In addition, a material of the insulator 126 may be a thermosetting resin such as an epoxy resin, a thermoplastic resin such as polyimide, or a resin in which these resins are impregnated with a core such as glass fiber, glass cloth, and glass fabric together with an inorganic filler. For example, an insulating material such as prepreg, Ajinomoto build-up film (ABF), FR-3, and bismaleimide triazine (BT) may be used.

The radio wave guide unit 122 may be provided with a first radio wave guide unit 122*a* in which an inner surface of the insulator is disposed vertically, and a second radio wave guide unit 122*b* in which an inner surface of the insulator 126 is disposed to be inclined to extend from the first radio wave guide unit 122*a*.

A height H1 of the first radio wave guide unit 122*a* may be changed according to a bandwidth of the radio wave to be transmitted. As an example, the first radio wave guide unit 122*a* may have a height of 0.1 mm to 0.8 mm.

Meanwhile, a height H2 and an inclination angle θ of the second radio wave guide unit 122*b* may be changed according to a field of view (FOV). As an example, the second radio wave guide unit 122*b* may have a height of 0.4 mm to 1.6 mm, and the second radio wave guide unit 122*b* may have an inclination angle θ of 25° to 75°.

An outermost edge of the radio wave guide unit 122 may have a rectangular shape when viewed from above.

The transmission antenna 130 may be provided on the substrate 110 to be disposed in a lower portion of the radio wave guide unit 122. As an example, the transmission antenna 130 may be provided to form a plurality of layers. The transmission antenna 130 disposed in an upper portion of the transmission antenna 130 forming a plurality of layers may be smaller than the transmission antenna 130 disposed in a lower portion thereof. Accordingly, it is possible to reduce an interference of the radio wave transmission of the transmission antenna 130 disposed in a lower portion by the transmission antenna 130 disposed in an upper portion. As an example, the transmission antenna 130 may be provided with a first transmission antenna 132 disposed on the upper surface of the substrate 110, a second transmission antenna 134 embedded in the substrate 110 to be disposed in a lower portion of the first transmission antenna 132 and larger than the first transmission antenna 132, and a third transmission antenna 136 embedded in the substrate 110 to be disposed in a lower portion of the second transmission antenna 134 and larger than the second transmission antenna 134. However, in the present embodiment, a case in which the transmission antenna 130 includes the first, second, and third transmission antennas 132, 134, and 136 is illustrated, but the transmission antenna 130 may be formed of two layers or four or more layers.

In addition, transmission antenna 130 forming a plurality of layers may be connected in series or in parallel with each other. The transmission antenna 130 may be connected to a wiring layer provided on the substrate 110.

The reception antenna 140 is disposed adjacent to the auxiliary substrate 120 on the upper surface of the substrate 110. As an example, the reception antenna 140 may be provided to form a plurality of rows. The plurality of the reception antenna parts 140 may have the same size. As such, since the reception antenna 140 is provided to form a plurality of rows, a reception efficiency of the radio wave may be improved. In addition, the reception antenna 140 may be connected to a wiring layer provided on the substrate 110.

As described above, radio wave acquisition characteristics may be secured while a field of view (FOV) is widened through the auxiliary substrate 120 having the radio wave guide unit 122.

Figure 4:
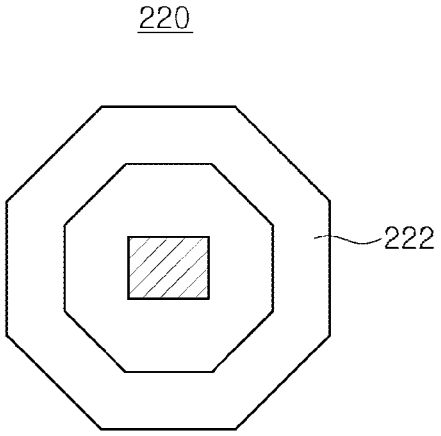
FIG. 4 is a plan view illustrating one or more examples of a first modified embodiment of an auxiliary substrate.

FIG. 4 is a plan view illustrating one or more examples of a first modified embodiment of an auxiliary substrate.

Referring to FIG. 4, a radio wave guide unit 222 may be provided on an auxiliary substrate 220. When viewed from above, an outermost edge of the radio wave guide unit 222 may have an octagonal shape. However, in the present embodiment, a case in which the outermost edge of the radio wave guide unit 222 has a regular octagonal shape is illustrated, but is not limited thereto, and may have an octagonal shape having sides having different lengths.

Figure 5:
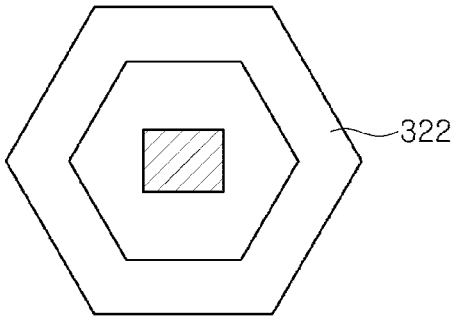
FIG. 5 is a plan view illustrating one or more examples of a second modified embodiment of an auxiliary substrate.

FIG. 5 is a plan view illustrating one or more examples of a second modified embodiment of an auxiliary substrate.

Referring to FIG. 5, a radio wave guide unit 322 may be provided on an auxiliary substrate 320. When viewed from above, an outermost edge of the radio wave guide unit 322 may have a hexagonal shape. However, in the present embodiment, a case in which the outermost edge of the radio wave guide unit 222 has a regular hexagonal shape is illustrated, but is not limited thereto, and may have a hexagonal shape having sides having different lengths.

Figure 6:
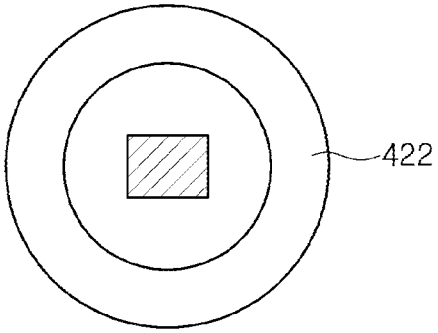
FIG. 6 is a plan view illustrating one or more examples of a third modified embodiment of an auxiliary substrate.

FIG. 6 is a plan view illustrating one or more examples of a third modified embodiment of an auxiliary substrate.

Referring to FIG. 6, a radio wave guide unit 422 may be provided on an auxiliary substrate 420. When viewed from above, an outermost edge of the radio wave guide unit 422 may have a circular shape.

Figure 7:
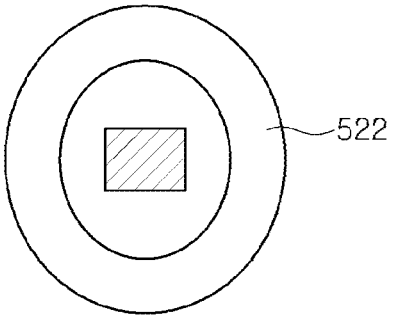
FIG. 7 is a plan view illustrating one or more examples of a fourth modified embodiment of an auxiliary substrate.

FIG. 7 is a plan view illustrating one or more examples of a fourth modified embodiment of an auxiliary substrate.

Referring to FIG. 7, a radio wave guide unit 522 may be provided on an auxiliary substrate 520. When viewed from above, an outermost edge of the radio wave guide unit 522 may have an oval shape.

As set forth above, one or more examples of the antenna apparatus according to the embodiments set forth herein can implement an effect that can secure radio wave acquisition characteristics while widening a field of view (FOV).

While specific examples have been shown and described above, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna apparatus, comprising:

a substrate;

a transmission antenna disposed on the substrate; and an auxiliary substrate disposed in an upper portion of the transmission antenna and comprising a radio wave guide unit comprising a horn shape, wherein the auxiliary substrate further comprises an insulator and a second metal pattern disposed in the radio wave guide unit on the insulator.

2. The antenna apparatus of claim 1, wherein the substrate comprises a plurality of vias disposed to surround the transmission antenna.

3. The antenna apparatus of claim 2, wherein an interval between the vias is 380 μm or less.

4. The antenna apparatus of claim 1, further comprising a reception antenna disposed on the substrate adjacent to the transmission antenna.

5. The antenna apparatus of claim 1, wherein the transmission antenna comprises a plurality of layers.

6. The antenna apparatus of claim 5, wherein the transmission antenna disposed in an upper portion of the transmission antenna forming the plurality of layers is smaller than the transmission antenna disposed in a lower portion thereof.

7. The antenna apparatus of claim 1, wherein the second metal pattern is disposed on top and bottom surfaces of the insulator.

8. The antenna apparatus of claim 1, wherein the substrate comprises a first metal pattern corresponding to the shape of the auxiliary substrate and disposed on the upper surface of the substrate.

9. The antenna apparatus of claim 1, wherein the substrate and the auxiliary substrate are bonded to each other by solder.

10. The antenna apparatus of claim 1, wherein the radio wave guide unit comprises a first radio wave guide unit in which an inner surface of the insulator is disposed vertically, and a second radio wave guide unit in which an inner surface of the insulator is inclined to extend from the first radio wave guide unit.

11. The antenna apparatus of claim 10, wherein the first radio wave guide unit comprises a height of 0.1 mm to 0.8 mm.

12. The antenna apparatus of claim 10, wherein the second radio wave guide unit comprises a height of 0.4 mm to 1.6 mm.

13. The antenna apparatus of claim 10, wherein an inner surface of the insulator forming the second radio wave guide unit comprises an inclination angle of 25° to 75°.

14. An antenna apparatus, comprising:

a substrate;

a transmission antenna disposed on the substrate; and an auxiliary substrate comprising a radio wave guide unit disposed in an upper portion of the transmission antenna, wherein the transmission antenna comprises a first transmission antenna disposed on an upper surface of the substrate and a second transmission antenna disposed in a lower portion than the first transmission antenna and comprising a larger size than the first transmission antenna.

15. The antenna apparatus of claim 14, further comprising a reception antenna disposed on the substrate adjacent to the transmission antenna.

16. The antenna apparatus of claim 14, wherein the substrate comprises a plurality of vias disposed to surround the transmission antenna.

* * * * *